US005152149A

United States Patent [19]

Mostello et al.

[11] Patent Number: 5,152,149

[45] Date of Patent: Oct. 6, 1992

[54] AIR SEPARATION METHOD FOR SUPPLYING GASEOUS OXYGEN IN ACCORDANCE WITH A VARIABLE DEMAND PATTERN

[75] Inventors: Robert A. Mostello, Somerville; Vito Kligys, Edison, both of N.J.

[73] Assignee: The BOC Group, Inc., Murray Hill, N.J.

[21] Appl. No.: 734,705

[22] Filed: Jul. 23, 1991

[51] Int. Cl.[5] ..... F25J 3/02

[52] U.S. Cl. ..... 62/28; 62/39; 62/40; 62/41

[58] Field of Search ..... 62/38, 39, 40, 41, 24, 62/27, 28

[56] References Cited

U.S. PATENT DOCUMENTS

| | | | |
|---|---|---|---|
| 3,058,315 | 10/1962 | Schuftan | 62/52 |
| 3,174,293 | 3/1965 | Jacob et al. | 62/39 |
| 3,500,651 | 3/1970 | Becker | 62/41 |
| 4,054,433 | 10/1977 | Buffiere et al. | 62/40 |
| 4,372,764 | 2/1983 | Theobald | 62/41 |

FOREIGN PATENT DOCUMENTS

| | | |
|---|---|---|
| 54983 | 11/1990 | Australia . |
| 6151233 | 2/1984 | Japan . |

OTHER PUBLICATIONS

Linde Reports on Science and Technology, No. 35, 1984.

Bascule System developed by L'Air Liquids.

*Primary Examiner*—Ronald C. Capossel

*Attorney, Agent, or Firm*—David M. Rosenblum; Larry R. Cassett

[57] ABSTRACT

An air separation method for supplying gaseous oxygen to meet the requirements of a variable demand cycle. In accordance with present invention, air is rectified by a double column low temperature rectification process to produce a nitrogen rich vapor and liquid oxygen in high and low pressure columns. The nitrogen rich vapor and the liquid oxygen are withdrawn from the high and low pressure columns, respectively. The nitrogen rich vapor is partially heated within a main heat exchanger of the process and is then, turboexpanded to create plant refrigeration. When a demand for gaseous oxygen exists, a product stream formed of withdrawn liquid oxygen is pumped to delivery pressure and the nitrogen rich vapor is diverted within the main heat exchanger from being partially heated and expanded and is fully heated, compressed and then condensed against vaporizing the product stream to form the gaseous oxygen. The condensed nitrogen is then flashed into a flash tank. The flash vapor is added to the diverted nitrogen rich vapor to increase the vaporization rate of gaseous oxygen. The resultant liquid is introduced into the low pressure column as reflux to allow the withdrawal of the liquid oxygen. Any excess amounts of the liquid oxygen and condensed nitrogen not immediately used are stored.

9 Claims, 1 Drawing Sheet

AIR SEPARATION METHOD FOR SUPPLYING GASEOUS OXYGEN IN ACCORDANCE WITH A VARIABLE DEMAND PATTERN

BACKGROUND OF THE INVENTION

The present invention relates to an air separation method for supplying gaseous oxygen in accordance with the requirements of a variable demand pattern.

A variety of industrial processes have time varying oxygen requirements. For example, steel mini-mills utilize oxygen in the reprocessing of scrap steel. Since the scrap steel is processed by such mills in batches or heats, the demand for oxygen varies between a high demand phase during batch processing and a low demand phase between batch processing. In order to meet such oxygen demand requirements, the prior art has provided air separation plants that are designed to supply gaseous oxygen in accordance with a variable demand pattern having high and low demand phases. Such air separation plants can generally be said to store liquid oxygen during the low demand phase and to store liquid nitrogen during the high demand phase. Moreover, the liquid nitrogen and the gaseous oxygen product are produced by vaporizing the stored liquid oxygen against condensing gaseous nitrogen produced by the plant.

In one type of plant design, the gaseous oxygen product is directly supplied from the low pressure column of an air separation unit having a high pressure column operatively associated with the low pressure column by a condenser/reboiler. In such a plant design, the gaseous oxygen product is produced by evaporation of liquid oxygen in the low pressure column against condensation of gaseous nitrogen in the high pressure column. In another type of plant design condensation of nitrogen and evaporation of oxygen occur in heat exchangers external to an air separation plant rather than in low and high pressure columns of such a plant.

An example of the type of air separation plant in which the gaseous product oxygen is supplied from the low pressure column is described in "Linde Reports on Science and Technology", No. 37, 1984. The plant disclosed in this publication supplies gaseous oxygen at a nominal production rate by extracting vaporized oxygen from the low pressure column. The oxygen vaporizes against the condensation of nitrogen produced at the top of the high pressure column. A stream of the high pressure nitrogen is extracted from the high pressure column and is subsequently heated, compressed, partially cooled, and turboexpanded to supply plant refrigeration.

In the plant described above, the amount of high pressure nitrogen extracted to supply plant refrigeration is controlled to adjust the amount of gaseous oxygen supplied, either above or below the nominal rate. During the high demand phase, the amount of high pressure nitrogen extracted from the high pressure column is reduced below that which is required to be extracted to produce gaseous oxygen at the nominal production rate. As a result, there is an increase in the degree to which liquid oxygen in the bottom of the low pressure column evaporates and high pressure nitrogen at the top of the high pressure column condenses. This produces an increase in the amount of liquid nitrogen collected at the top of the high pressure column which is extracted and stored in a storage tank. Liquid oxygen, stored in another storage tank during the low demand phase, is supplied to the low pressure column to replenish oxygen in the bottom of the low pressure column. During the low demand phase, the amount of high pressure nitrogen extracted from the high pressure column is increased over that required to be extracted in the production of oxygen at the nominal rate. This increases the amount of liquid oxygen collected at the bottom of the low pressure column because there is less high pressure nitrogen at the top of the high pressure column to condense. The increased amount of liquid oxygen collected in the low pressure column is extracted and stored for use in the high demand phase while previously stored high pressure nitrogen is introduced to the top of the low pressure column as reflux to wash down the oxygen and to add refrigeration. Processes of this design are limited by a ratio of maximum oxygen production to average oxygen production of about 1.5, owing to the means effected for varying the oxygen production rate.

An example of an air separation plant in which evaporation and condensation of oxygen and nitrogen takes place in added heat exchangers and vaporizers is described in U.S. 3,273,349. The air separation plant described in this patent is designed to supply liquid oxygen and waste nitrogen at nominal rates of production. During periods of low or no oxygen demand, liquid oxygen is stored in a storage vessel while liquid nitrogen, previously produced and stored during the high demand period is returned to the air separation plant for use as reflux to the low pressure column thereof. During periods of high demand, liquid oxygen from the storage vessel is pumped through a heat exchanger while waste nitrogen is compressed and is countercurrently passed through the heat exchanger. As a result, the liquid oxygen is vaporized for supply as product and the compressed nitrogen condenses and is stored for use during the low demand period.

Design and operational problems exist in variable demand oxygen plants in which gaseous oxygen is supplied directly from the low pressure column. For instance, optimization of the hydraulic design of the column and oxygen recovery over the full extent of the demand pattern are highly problematical. A major operational problem is that it is difficult to control the purity of the oxygen being recovered. Also, the oxygen that is recovered is supplied at too low a pressure to be practically utilized in an industrial process. As a consequence, the pressure of the oxygen must be increased by use of an oxygen compressor. It is to be noted that in variable demand oxygen plants in which oxygen is supplied by pumping liquid oxygen through a heat exchanger or vaporizer, the oxygen is supplied at a usable working pressure without the use of an oxygen compressor. However, while equipment costs may at least in part be saved in such a plant design, operating costs are increased in that there are energy losses involved in vaporizing oxygen and condensing nitrogen outside of the cold box. As may be appreciated, both type of Plant designs involve the use of additional compressors, heat exchangers and etc. that in any event significantly add to plant cost and complexity.

As will be discussed the present invention provides a method that is capable of supplying gaseous oxygen over a variable demand pattern at usable working pressures and over a wider range of demand than that contemplated in the prior art. While being totally integrated, the method of the present invention is far less complex than that involved in variable demand oxygen plants of the prior art. Additionally, column operation in a process of the present invention is very stable. This eliminates the design and operational problems associated with variable oxygen demand plants in which the oxygen is supplied directly from the low pressure column.

SUMMARY OF THE INVENTION

The present invention provides a process for supplying gaseous oxygen to meet the requirements of a variable demand pattern. In accordance with such process air is rectified by a double column low temperature rectification process. The rectification process utilizes operatively associated high and low pressure columns to produce a nitrogen rich vapor and liquid oxygen, respectively. The nitrogen rich vapor and the liquid oxygen are withdrawn from the high and low pressure columns.

The withdrawn nitrogen rich vapor is partially heated and then, engine expanded with the performance of work. After the expansion, the withdrawn nitrogen rich vapor stream is introduced into the low temperature rectification process as plant refrigeration such that the heat balance is maintained over the course of the demand pattern.

When a demand for the gaseous oxygen exists, a product stream formed from the withdrawn liquid oxygen is pumped to delivery pressure rather than having to be compressed to delivery pressure by an oxygen compressor. Concurrently, at least some of the nitrogen rich vapor is diverted from being partially heated and expanded, and is fully, heated, compressed and then condensed against vaporizing the product stream to thereby form the gaseous oxygen. The nitrogen rich vapor is diverted at a rate sufficient to vaporize the product stream and the product stream is pumped at a sufficient rate to meet the demand.

Liquid nitrogen condensed from the diverted nitrogen rich vapor is flashed to produce a two phase flow of nitrogen containing liquid and vapor phases. The liquid and vapor phases are separated from one another and a vapor phase stream is added back into the diverted nitrogen rich vapor prior to its being fully heated to increase production of the gaseous oxygen. As mentioned previously, prior art variable oxygen demand plants are only capable of gaseous oxygen production of about one and and one-half times the nominal production rate of the plant. The addition of the vapor phase stream, in effect a recycle stream, allows even more liquid oxygen to be vaporized to increase gaseous oxygen production rates to as much as two times the plant's nominal production rate of oxygen.

In a double column rectification process or apparatus, liquid nitrogen is added as reflux to drive the oxygen to the bottom of the columns. Reflux must also be added to the low pressure column in order to extract liquid oxygen from the low pressure column. In the subject invention, a liquid nitrogen stream composed of the liquid phase of the flash is introduced into the low pressure column as such reflux. Any excess amounts of the liquid nitrogen not introduced to the low pressure column and of the withdrawn liquid oxygen not used in forming the product stream are stored.

An important option of the present invention is that the liquid nitrogen stream is added to the low pressure column at a rate varying with the introduction of plant refrigeration such that the liquid oxygen is produced at an essentially constant rate. As may be appreciated, as the demand for gaseous oxygen decreases, the engine expansion of nitrogen rich vapor increases to also increase Production of plant refrigeration. Since the liquid nitrogen reflux serves both to wash down the oxygen and as a source of refrigeration, the amount of liquid nitrogen reflux must be decreased to maintain an essentially constant rate of liquid oxygen production. The reverse operation, namely, more liquid nitrogen reflux is added as the demand for gaseous oxygen increases, as refrigeration from engine expansion is less at this time.

It is the steady operation of the process of the present invention that allows for optimum column design and liquid oxygen production over that allowed for in prior art processes in which gaseous oxygen product is removed from the low pressure column. In addition, since liquid oxygen production is constant, it is far simplier to maintain product purity over such prior art processes.

It is to.be noted from the above description that the main heat exchanger of the plant can be used to effectuate heat transfer between liquid oxygen and nitrogen to produce the gaseous oxygen product and the liquid nitrogen to be used as reflux. Moreover, a single nitrogen rich gas stream is being used to serve three purposes, namely, to vaporize liquid oxygen, as reflux, and as a plant refrigerant. The multi-purpose use of the nitrogen rich gas stream in itself allows a plant to be constructed that is far simpler in layout and cost than plant designs of the prior art because additional compressors and expanders are not required. In addition, since the oxygen is being supplied from outside of the low pressure column, its pressure can be economically raised by pumping the liquid oxygen through the main heat exchanger rather than compressing the gaseous oxygen product with an oxygen compressor.

BRIEF DESCRIPTION OF THE DRAWINGS

While the specification concludes with claims particularly pointing out the subject matter that Applicants regard as their invention, it is believed that the invention will be better understood from the following description taken in conjunction with the accompanying drawing in which the sole FIGURE is a schematic view of an air separation plant in accordance with the present invention.

DETAILED DESCRIPTION

Figure 1:
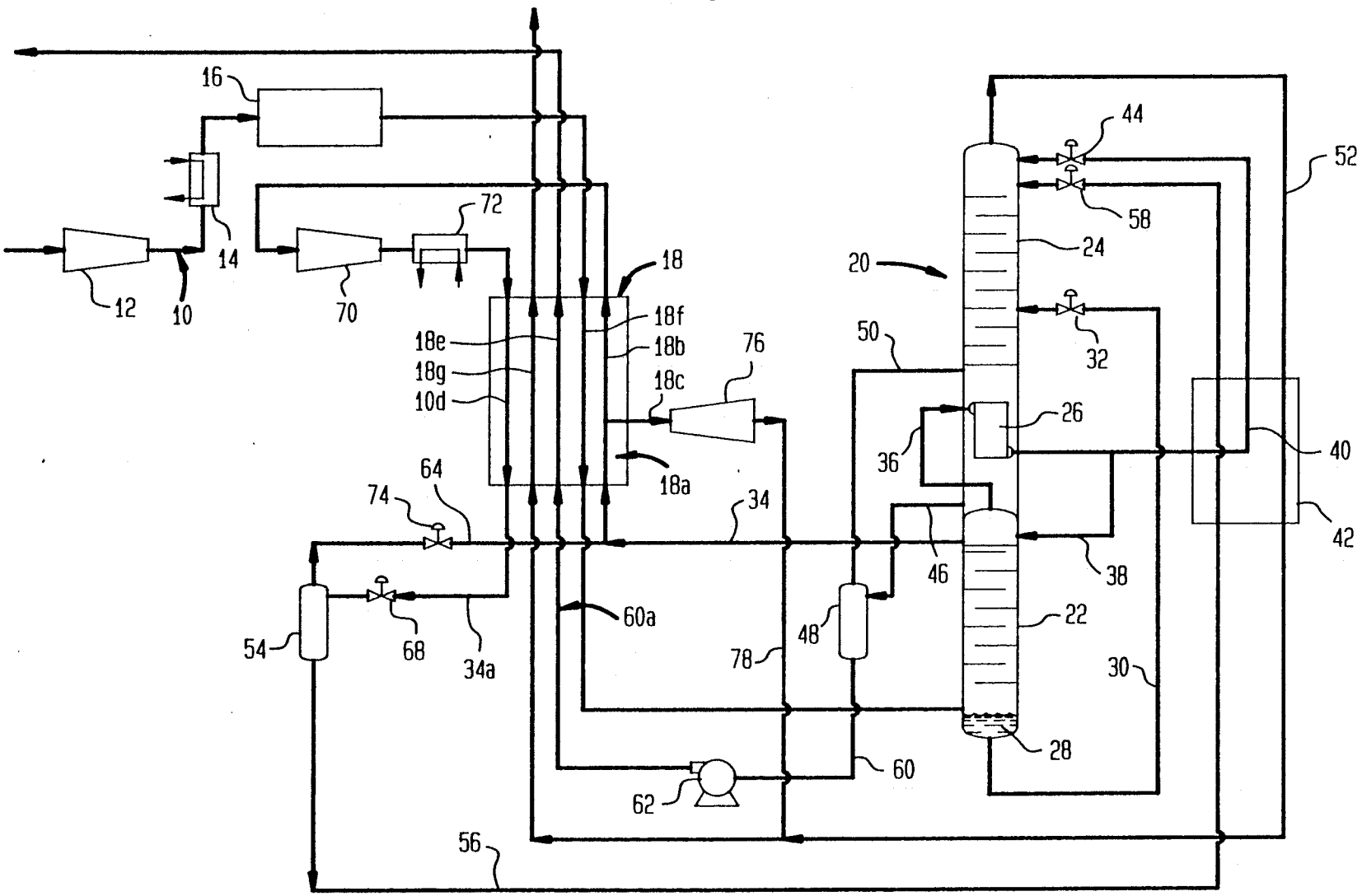

The FIGURE illustrates an air separation plant in accordance with the present invention. It is specifically designed to produce gaseous oxygen as a product having a purity of about 95.0%. The oxygen produced by the air separation plant is supplied in accordance with a variable demand pattern having a high demand phase lasting about 32.0 minutes in which 279.77 moles/hr. of the oxygen at a temperature of about 18.9° C. and a pressure of about 11.74 kg/cm$^2$ is supplied as a product. The rate of supply is roughly 1.87 times the plant's nominal production rate of oxygen. The demand cycle also has an alternating low demand phase following the high demand phase of approximately 28.0 minutes in which no gaseous oxygen is supplied.

It is to be noted that in the following discussion, that all pressures are given in absolute units and that moles are in units of kilogram moles. Additionally, while the discussion centers on streams passing between components of the air separation plant, it is understood that the reference numerals designating streams also designate piping between the components to conduct the streams.

In operation, an air stream 10 at ambient temperature and pressure, (approximately 22.2° C. and about 1.02 kg/cm$^2$) and flowing at a flow rate of about 689.30 moles/hr is compressed in a compressor 12 to about 5.88 kg/cm$^2$. Preferably, air stream 10 is passed through an aftercooler 14, through which the air is cooled back to about 22.2° C. Air stream 10 then passes through a purifier 16 to remove carbon dioxide and water vapor from stream 10. Purifier 16 is composed of molecular sieve or a dual (unmixed) media of alumina and molecular sieve or alumina alone. After passage through purifier 16, air stream 10 undergoes a pressure drop of about 0.246 kg/cm$^2$, is subsequently further cooled in a main heat exchanger 18 to a temperature suitable for its rectification. Thereafter, air stream 10 is introduced into an air separation unit 20 having connected high and low pressure columns 22 and 24. Column 22 has about 21 trays and column 24 has about 39 trays. High and low pressure columns 22 and 24 are operatively associated with one another by a condenser/reboiler 26.

Main heat exchanger 18 has a branched first pass 18*a* having a main segment 18*b* and a branch segment 18*c*. For purposes that will be discussed hereinafter, nitrogen rich vapor from high pressure column 22 fully warms in main segment 18*b* and partially warms in branch segment 18*c*. A second pass 18*d* is provided within main heat exchanger 18 to condense fully heated and compressed nitrogen rich vapor after having passed through main segment 18*b* of first pass 18*a*. This is accomplished by vaporizing liquid oxygen passing through a third pass 18*e* of main heat exchanger 18. Forth and fifth passes 18*f* and 18*g* of main heat exchanger 18 are connected to high and low pressure columns 22 and 24, respectively, for cooling the air to the temperature suitable for its rectification against fully heating low pressure nitrogen from low pressure column 24.

In high pressure column 22, the more volatile nitrogen rises and the less volatile oxygen falls from tray to tray and collects in the bottom of high pressure column 22 to form an oxygen-rich liquid 28 having a temperature of about −173.95° C. and a pressure of about 5.52 kg/cm$^2$. A stream 30 of oxygen-rich liquid 28 is extracted from the high pressure column, is throttled through a valve 32, and is subsequently introduced into low pressure column 24 at about 29 trays from the top thereof for further separation.

The more volatile nitrogen within high pressure column 22 collects at the top thereof as the aforementioned nitrogen rich gas, which for purposes that will be discussed hereinafter, is extracted from high pressure column 22 as a stream 34 having a substantially constant flow rate throughout the demand pattern of approximately 303.91 moles/hr. and a temperature of about −177.97° C. Such nitrogen-rich gas is also extracted as a stream 36 which is passed into condenser/reboiler 26, where it is condensed against liquid oxygen collecting in the bottom of low pressure column 24. A partial stream 38 of the condensed nitrogen is returned to the top of high pressure column 22 as reflux and another partial stream 40 of the condensed nitrogen is passed through a sub-cooler 42. After further cooling of partial stream 40 in sub-cooler 42, partial stream 40 is throttled through a flow control valve 44 and is introduced into the top of low pressure column 24 as reflux. Flow control valve 44 also acts to control the flow of reflux into both the low and high pressure columns to maintain nitrogen purity in the high pressure column.

Liquid oxygen collected in the bottom of low pressure column 24, which has not been vaporized, is extracted from the bottom of low pressure column 24 as a stream 46 for reception within oxygen vessel 48. Oxygen vessel 48 is connected, at the top thereof, to low pressure column 24 via a line 50 so that the vapor pressure within oxygen vessel 48 is approximately equal to low pressure column 24.

A stream 52 of low pressure nitrogen (mentioned above with respect to main heat exchanger 18) is withdrawn from the top of low pressure column 24. Stream 52 has a temperature of approximately −193.20° C. and a pressure of about 1.375 kg/cm$^2$. Stream 52 passes through sub-cooler 42 where it warms against the cooling of streams 40 and 56. Thereafter, stream 52 enters fifth pass 18*g* of main heat exchanger 18 to cool incoming air stream 10 flowing through forth pass 18*f* of main heat exchanger 18. Stream 52 is then discharged from the plant as waste nitrogen.

Reflux is also supplied to low pressure column 24 from a flash tank 54 having a capacity of approximately 6000.0 liters. This reflux is necessary to allow the extraction of liquid oxygen from low pressure column 24. Excess amounts of liquid nitrogen, accumulated in flash tank 54 during the high demand phase, are extracted as a stream 56 which is further cooled in sub-cooler 42 against the warming of low pressure nitrogen stream 52. After such further cooling, stream 56 passes through a flow control valve 58 and is introduced into the top of low pressure column 24. As will be discussed in greater detail below, flow control valve 58 is used in metering the amount of reflux being supplied to low Pressure column 24 such that liquid oxygen is produced in low pressure column 24 at an essentially constant rate.

The following is a discussion of plant operation during the high demand phase. During the high demand phase, that is when a demand for gaseous oxygen exists, a product stream 60 composed of liquid oxygen from oxygen vessel 48 is pumped by a pump 62 through third pass 18*e* of main heat exchanger 18. The flow rate of product stream 60 is sufficient to meet the demand.

In the illustrated embodiment and example, liquid oxygen stream 46 flows at about 148.17 moles/hr. into oxygen vessel 48. Product stream 60 of liquid oxygen is pumped from liquid oxygen collection vessel 48 by a pump 62 at a rate of approximately 279.77 moles/hr. and a delivery pressure of approximately 11.90 kg/cm$^2$ through third pass 18*e* of main heat exchanger 18. At the same time, flash vapor stream 64 is introduced into stream 34 which then flows along a flow path which includes main segment 18*b* of first pass 18*a* of main heat exchanger 18, a booster compressor 70, preferably an aftercooler 72, and then second pass 18*d* of main heat exchanger 18. Stream 34 fully warms in main heat exchanger 18 to a temperature of approximately 18.9° C. Stream 34, at about 5.32 kg/cm$^2$ is then compressed in booster compressor 70 to a pressure of about 30.45 kg/cm$^2$, is cooled by after cooler 72, and is condensed within second pass 18*d* of main heat exchanger 18 against vaporizing product stream 60 concurrently passing through third pass 18*e* of main heat exchanger 18. After passage through main heat exchanger 18, product stream 60 heats to a temperature of approximately 18.9° C. and undergoes a slight drop in pressure to about 11.70 kg/cm$^2$. Oxygen at such pressure can be supplied directly to a steel furnace without having to be pumped, compressed, etc.

Liquid nitrogen condensed from stream 34, designated in the drawings as stream 34*a*, is then flashed into flash tank 54 for production of stream 56 that, as has been discussed, is used as reflux to low pressure column 24. After condensation, stream 34*a* gas a temperature of approximately −158.6° C. and a pressure of approximately 30.10 kg/cm$^2$. Stream 34*a* is throttled through a valve 68 to a sufficiently low pressure to produce two phases within condensed stream 34. Valve 68 also serves to control condensation by the back pressure it creates. The liquid and vapor phases of the two phases separate in flash tank 54 to produce a liquid phase containing the liquid nitrogen to be introduced into low pressure column 24 as reflux and a vapor phase containing flash vapor used in forming flash vapor stream 64. Flash vapor stream 64 leaves flash tank 54 at a temperature of approximately −177.7° C. and a pressure of about 5.62 kg/cm$^2$ and is throttled through a throttle valve 74 to equal the pressure of nitrogen-rich gas stream 34 which is effectively the pressure of high pressure column 22. It is to be noted that throttle valve 74 acts to control the amount of flash and to pressurize flash tank 54 so that stream 56 flows to low pressure column 24 without the use of a pump.

It also should be pointed out that, during the high demand phase, stream 30 has a flow rate of approximately 375.62 moles/hr. and low pressure nitrogen stream 52 has a flow rate of approximately 396.95 moles/hr. The two reflux nitrogen streams, stream 40 and stream 56 respectively have flow rates of approximately 9.77 moles/hr. and 159.73 moles/hr. Both of such reflux nitrogen streams after passing through sub-cooler 42 are cooled to a approximately −191.3° C., while stream 52 is warmed to a temperature of −182.2° C. Stream 52, after passage through main heat exchanger 18, is further warmed to about 18.9° C.

The following is a discussion of plant operation during the low demand phase. During the low demand phase, stream 34 flows along an alternative flow path which consists of branch segment 18*c* of first pass 18*a* of main heat exchanger 18 to be partially heated and then expanded with the performance of the work in turboexpander 76. The resultant expanded stream 78 is then added back into the process to supply plant refrigeration.

In main heat exchanger 18, stream 34 is partially heated to a temperature of about −158.3° C., and is then subsequently expanded from about 5.41 kg/cm$^2$ in turboexpander 76 to about 1.33 kg/cm$^2$ and about −191.3° C. The resultant turboexpanded stream 78 is combined with low pressure nitrogen stream 52 flowing at about 442.10 moles/hr. The combined stream is then sent through fifth pass 18*g* of main heat exchanger 18 at a flow rate of approximately 700.65 moles/hr. After leaving main heat exchanger 18, the combined stream heats to approximately 17.5° C.

The addition of refrigeration acts to lower the enthalpy of air stream 10 before its entry into high pressure column 22. In this regard, air stream 10 in the low demand phase has a temperature of about −173.9° C. and a content of about 7.02% liquid. During the high demand phase, air stream 10 also has a temperature of about −173.9° C. Additionally, liquid oxygen at a rate of 150.84 moles/hr., essentially the same flow rate as in the high demand phase, is being removed as stream 46 from low pressure column 24. In order to maintain heat balance while keeping the liquid oxygen production rate essentially constant, valve 58 is set to reduce the flow rate of stream 56 to about 162.18 moles/hr. Since the condenser duty is slightly larger in high pressure column 22, the flow rate of partial stream 40 increases to about 56.70 moles/hr.

Streams 40 and 56 are subsequently cooled in subcooler 42 to approximately −191.4° C. before introduction in low pressure column 24. It is also to be noted that during such interval, oxygen enriched stream 30 flows at a rate of approximately 374.05 moles/hr.

Stream 34 is diverted from one flow path to the other by turning turboexpander 76 and booster compressor 70 on and off. For instance, during the high demand phase, turboexpander 76 is shut off while compressor 70 is turned on. This causes the nitrogen rich vapor from stream 34 to divert itself from its use in supplying plant refrigeration, that is, its flow to turboexpander 76, to flow in main segment 18*b* of first pass 18*a* of main heat exchanger 18. The reverse operation occurs during the low demand phase.

It is important to point out that the foregoing represents only one of many possible modes of plant operation in accordance with the present invention. For instance rather than on-off operation, turboexpander 76 could be set to vary the diverted flow rate in accordance with the level of demand, which might never cease during a particular demand pattern. During such a demand pattern, as demand for gaseous oxygen increased, turboexpander 76 could be controlled or regulated in a conventional manner to steadily reduce the flow of the nitrogen rich vapor therein so that anywhere from some to all of the nitrogen rich vapor would be available to be fully heated, compressed and condensed. At the same time, the flow of liquid nitrogen reflux would be increased with the decrease in the refrigeration being added to the process. As demand for gaseous oxygen decreased, turboexpander 76 could then be controlled to steadily increase the flow of the nitrogen rich vapor therein so that progressively less nitrogen rich vapor would be available to be fully heated, compressed, and condensed. Concomitantly, the flow of liquid nitrogen reflux would be decreased with the increase of refrigeration being added to the process.

Simply stated, while the on-off operation of the present invention as has been described above is an important mode of possible operation, it is not the only mode of plant operation in accordance with the present invention.

While a preferred embodiment of the invention has been shown and described in detail, it will be readily understood and appreciated by those skilled in the art, that numerous omissions, changes and additions may be made without departing from the spirit and scope of the invention.

We claim:

1. A method of supplying gaseous oxygen to meet the requirements of a variable demand pattern comprising:

rectifying air by a double column low temperature rectification process using operatively associated high and low pressure columns to produce a nitrogen rich vapor and liquid oxygen, respectively;

withdrawing a nitrogen rich vapor stream composed of the nitrogen rich vapor and a liquid oxygen stream composed of the liquid oxygen from the high and low pressure columns, respectively;

partially heating and engine expanding with the performance of work the nitrogen rich vapor stream and after the engine expansion, introducing the nitrogen rich vapor stream into the double column low temperature rectification process as plant refrigeration such that heat balance is maintained over the course of the demand pattern;

when a demand for the gaseous oxygen exists, pumping a product stream formed from the liquid oxygen contained within the liquid oxygen stream to a delivery pressure, diverting at least part of the nitrogen rich vapor stream from being partially heated and expanded, and fully heating, compressing and then, condensing, the at least part of the nitrogen rich vapor stream against vaporizing the product stream to thereby form the gaseous oxygen, the at least part of the nitrogen rich vapor stream diverted at a rate sufficient to vaporize the product stream and the product stream being pumped at a sufficient rate to meet the demand;

flashing liquid nitrogen condensed from the at least part of the nitrogen rich vapor stream to produce a two phase flow of nitrogen containing liquid and vapor phases and separating the liquid and vapor phases from one another;

adding a vapor phase stream composed of the vapor phase to the at least part of the nitrogen rich vapor stream to increase production of the gaseous oxygen and adding a liquid nitrogen stream composed of the liquid phase to the low pressure column as reflux to allow withdrawal of the liquid oxygen as the liquid oxygen stream from the low pressure column; and storing any excess amounts of liquid phase not introduced to the low pressure column and of the liquid oxygen stream not used in forming the product stream.

2. The method of claim 1, wherein:

the liquid nitrogen stream is added to the low pressure column at a rate varying with the introduction of plant refrigeration such that the liquid oxygen is formed within the low pressure column at an essentially constant rate; and the nitrogen rich vapor and the liquid oxygen streams are withdrawn from the high and low pressure columns at essentially constant rates.

3. The method of claim 2, wherein:

the low temperature rectification process also utilizes a cooling stage to cool the air to a temperature suitable for its rectification;

the product stream is introduced into the cooling stage; and the nitrogen rich vapor stream is partially heated within the cooling stage and also, the at least part of the nitrogen rich vapor stream is fully heated within the cooling stage and after having been fully heated and compressed, is condensed within the cooling stage against vaporizing the product stream.

4. The method of claim 3, wherein the nitrogen rich vapor stream after having been expanded is added to the cooling stage to introduce the plant refrigeration into the double column low temperature rectification process by lowering the enthalpy of the air to be rectified.

5. The method of claim 4, wherein the liquid nitrogen is flashed into a flash tank to produce a nitrogen in liquid and vapor phases.

6. The method of claim 4, wherein:

the low pressure column produces low pressure nitrogen vapor;

a waste stream composed of the low pressure nitrogen vapor is extracted from the low pressure column;

the waste stream is introduced into the cooling stage to cool the air; and the nitrogen rich vapor stream after having been expanded is combined with the waste stream before introduction into the cooling stage to add the refrigeration to the double column low temperature rectification process.

storing any excess amounts of the liquid phase not introduced to the low pressure column and of the liquid oxygen stream not used in forming the product stream.

7. The method of claim 1, wherein:

the low temperature rectification process also utilizes a cooling stage to cool the air to a temperature suitable for its rectification;

the product stream is introduced into the cooling stage; and the nitrogen rich vapor stream is partially heated within the cooling stage and also, the at least part of the nitrogen rich vapor stream is fully heated within the cooling stage and after having been fully heated and compressed, is condensed within the cooling stage against vaporizing the product stream.

8. The method of claim 1, wherein:

the double column low temperature rectification process also utilizes a cooling stage to cool the air to a temperature suitable for its rectification within the rectification stage; and the nitrogen rich vapor stream after having been expanded is added to the cooling stage to introduce the plant refrigeration into the double column low temperature rectification process by lowering the enthalpy of the air to be rectified.

9. The method of claim 1, wherein the liquid nitrogen is flashed into a flash tank to separate the liquid and vapor phases from one another.

* * * * *